US005944366A

United States Patent [19]

Aramburu

[11] Patent Number: 5,944,366

[45] Date of Patent: Aug. 31, 1999

[54] LATCH BOLT ADAPTER

[75] Inventor: Luis Angel Ruano Aramburu, San Sebastian, Spain

[73] Assignee: Talleres de Escoriaza, S.A., Irun, Spain

[21] Appl. No.: 08/899,717

[22] Filed: Jul. 24, 1997

[30] Foreign Application Priority Data

Jul. 24, 1996 [ES] Spain ..... 9601647

[51] Int. Cl.[6] ..... E05C 1/00

[52] U.S. Cl. ..... 292/1.5; 292/337; 292/DIG. 60

[58] Field of Search ..... 292/1.5, 337, DIG. 60; 70/461

[56] References Cited

U.S. PATENT DOCUMENTS

| | | | |
|---|---|---|---|
| 2,249,272 | 7/1941 | Dey | 292/357 |
| 4,042,268 | 8/1977 | Coglan | 292/347 |
| 4,593,542 | 6/1986 | Rotondi et al. | 70/134 |
| 4,602,490 | 7/1986 | Glass et al. | 70/134 |
| 4,708,379 | 11/1987 | Ching | 292/337 |
| 4,725,086 | 2/1988 | Shen | 292/337 |
| 4,759,576 | 7/1988 | Ching | 292/337 |
| 4,895,404 | 1/1990 | Toledano | 292/337 |
| 4,957,315 | 9/1990 | Lin | 292/337 |
| 4,976,122 | 12/1990 | Doolan et al. | 70/134 |
| 5,152,558 | 10/1992 | Smith et al. | 292/1.5 |
| 5,456,503 | 10/1995 | Russell, IV | 292/1.5 |

*Primary Examiner*—Steven Meyers
*Assistant Examiner*—Clifford B. Vaterlaus
*Attorney, Agent, or Firm*—Laff, Whitesel, Conte & Saret, Ltd.; Robert F. I. Conte

[57] ABSTRACT

An adaptable latch having a bolt case. A bolt case extension is connected to the rear of the bolt case. The bolt case extension can be locked in position with the bolt case to place the latch in a short-length position or a long-length position. A bolt head is disposed in the bolt case. A bolt tail is connected to the rear of the bolt case. The bolt tail can be locked in position with the bolt head to place the latch in the short-length position or the long-length position. A spring-loaded lug allows for simultaneous unlocking of the bolt tail from the bolt head and the case extension from the bolt case. The bolt tail and case extension, when unlocked from a previous locked position, can be placed in another locked position to lock the latch in either the desired long-length position or the short-length position. The bolt tail is locked into position with the bolt head by way of a bolt tail appendage extending into a bolt head hollow. The bolt tail appendage locks with a bolt head catch in the bolt head hollow.

6 Claims, 3 Drawing Sheets

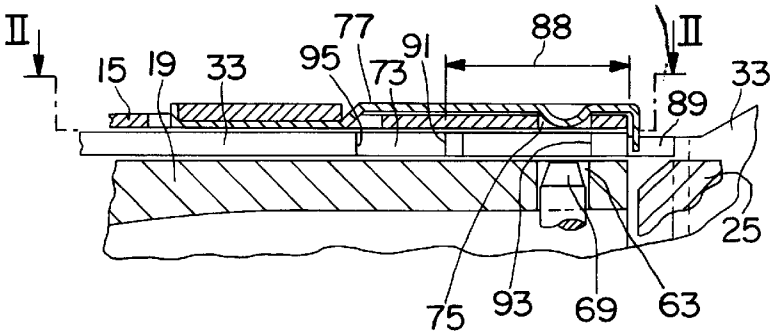
FIG. IB
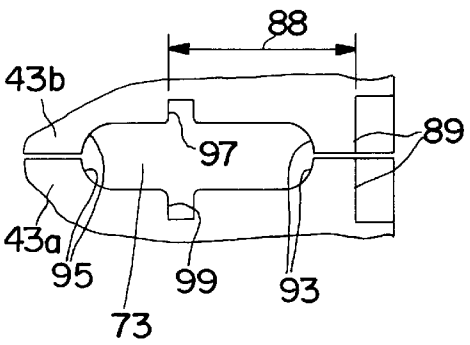
FIG. 2
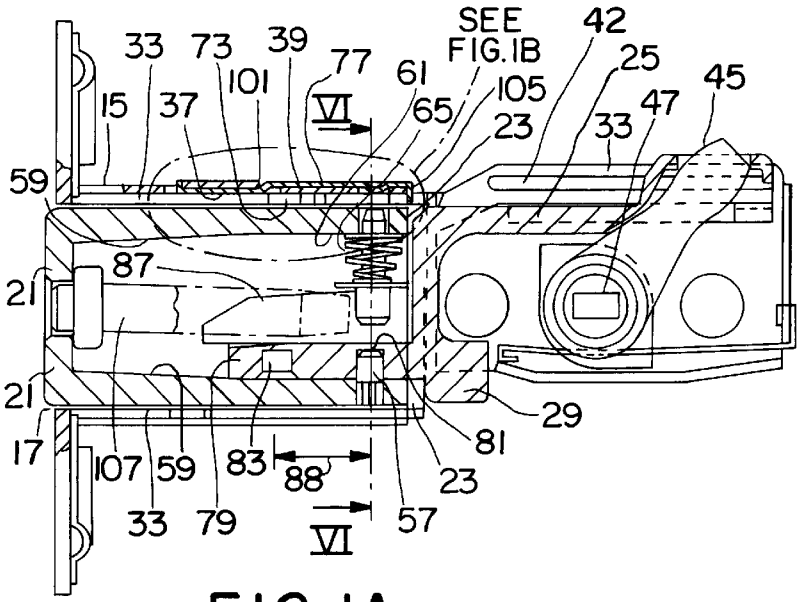
FIG. IA

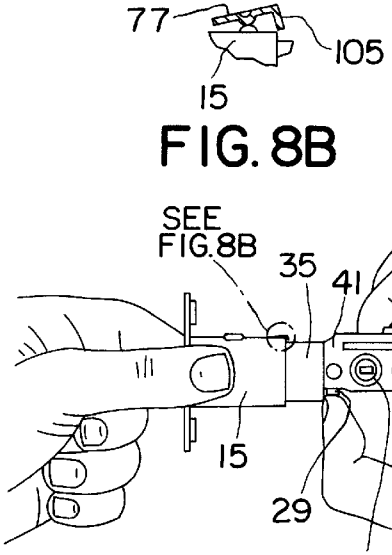
FIG. 8B
FIG. 8A
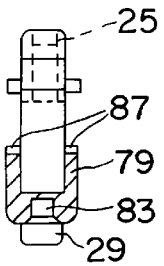
FIG. 10
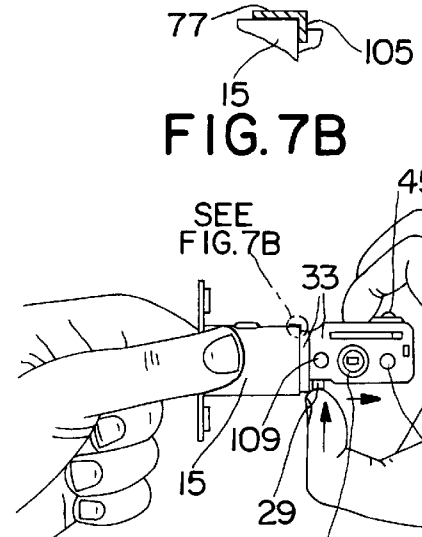
FIG. 7B
FIG. 7A
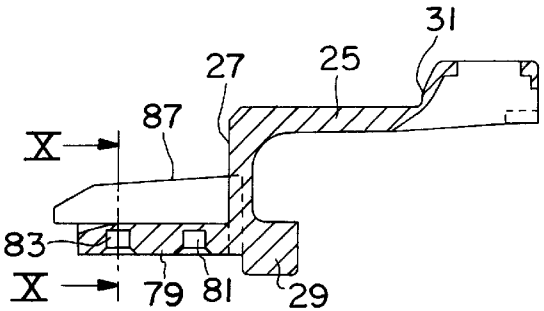
FIG. 9

LATCH BOLT ADAPTER

FIELD OF INVENTION

The invention relates to an adaptable latch. More particularly, the invention relates to a latch being adaptable to form either a short-length latch or a long-length latch.

BACKGROUND

Early on, industry manufactured both short- and long-length door latches. The short-length latch resulted in the door handle axle being about 60 mm from the door's edge. The long-length latch resulted in the door handle axle being about 70 mm from the door's edge.

Use of short- and long-length latches resulted in many doors existing in the marketplace having perforations, either for the long-length or the short-length latch. The existence of two distinct types of doors required services of door latches to stock both short and long latches. Services had to stock long latches to service doors previously perforated for long latches, and services had to stock short latches for doors previously perforated for short latches. In addition, manufacturers had to make both short and long door latches to fulfill the needs of their customers. It became very expensive to stock and manufacture both long and short door latches.

To solve the problem, industry developed a single latch capable of being adapted to fit either a door previously perforated for a short latch or previously perforated for a long latch. Some adaptable latches adapt by providing a linkage between an eccentric and two possible pre-established positions on a bolt tail. The design complicates the latch. The linkage requires provisions to provide for door axle rotation at either of the two linkage positions on the bolt tail.

Other devices provide for the adaptation within the bolt case. Some of these devices produce a helical movement between the extreme positions of 60 mm and 70 mm. Some of the devices produce the movement by a right side-up or upside-down U-shaped movement between the positions.

Accordingly, the present invention seeks to improve upon previous adaptable latches by providing a bolt head having a bolt head catch, and by providing a bolt tail having a bolt tail appendage. The bolt tail appendage has a bolt tail appendage first catch and a bolt tail appendage second catch. The bolt tail appendage first catch and the bolt tail appendage second catch are longitudinally spaced from each other along a longitudinal length of the latch. The bolt head catch locks with either the appendage first catch or the appendage second catch.

The invention further provides advantages by providing a bolt case extension having a bolt case extension first catch and a bolt case extension second catch. The case extension first catch and the case extension second catch are longitudinally spaced apart along the longitudinal length of the latch. A resilient catch coupled to the bolt case locks with either the bolt case extension first catch or the bolt case extension second catch.

The invention provides still a further advantage by providing a bolt tail protrusion which has a pressed position. The protrusion, when in the pressed position, unlocks the resilient catch from the case extension first catch or case extension second catch. In addition, it unlocks said bolt head catch from the bolt tail appendage first catch or the bolt tail appendage second catch.

The invention further improves upon prior latches by providing a spring-loaded lug which co-acts with both said bolt tail appendage and said resilient catch to provide for a simultaneous unlocking of said bolt head catch from said appendage and said resilient catch from said case extension.

SUMMARY

An adaptable latch having a bolt case. The bolt case has a bolt case opening. The bolt case has a resilient catch connected thereto. The latch further includes a bolt head. The bolt head has a bolt head interior surface defining a bolt head hollow. The bolt head is disposed in the bolt case and has a bolt head first section and a bolt head second section.

The latch has a bolt tail with a bolt tail first section and a bolt tail second section. A bolt tail appendage is connected to the bolt tail first section and disposed in the bolt tail hollow. The bolt tail appendage has a bolt tail appendage first catch and a bolt tail appendage second catch. The first catch is spaced from the second catch along the longitudinal length of the latch. A bolt head catch is disposed in the bolt head hollow. The bolt head catch and the bolt tail appendage have a variable positional relationship selected from a group consisting of the bolt head catch locked with the bolt tail appendage first catch, the bolt head catch locked with the bolt tail appendage second catch, and the bolt head catch unlocked from the bolt tail appendage.

A bolt case extension has a bolt case extension first catch and a bolt case extension second catch. The resilient catch and the bolt case extension have a variable positional relationship selected from a group consisting of the resilient catch locked with the bolt case extension first catch, the resilient catch locked with the bolt case extension second catch, and the resilient catch unlocked from the case extension.

Other desires, results and novel features of the present invention will become more apparent from the following drawings, detailed description and the accompanying claims.

BRIEF DESCRIPTION OF THE DRAWINGS

FIGS. 1A and 1B shows the longitudinal section, in its median vertical elevation, of a latch according to the invention in its state of short latch, including an enlargement of the area surrounded in the complete latch view.

FIG. 2 is a partial view in upper elevation of the case extension 33 according to section II—II shown in the enlarged detail on FIG. 1B

FIGS. 7A, 7B and 8A, 8B show a diagram of the sequential operation of switching from short latch to long latch (from FIG. 7A to FIG. 8A) and conversely (from FIG. 8A to FIG. 7A) showing the respective status of FIGS. 3 and 4 and including enlarged illustrative details of the position of the flange 105.

FIG. 9 shows the bolt tail individually 25 as it appears in FIG. 1A.

FIG. 10 is the section cut along X—X in FIG. 9.

Figure 5:
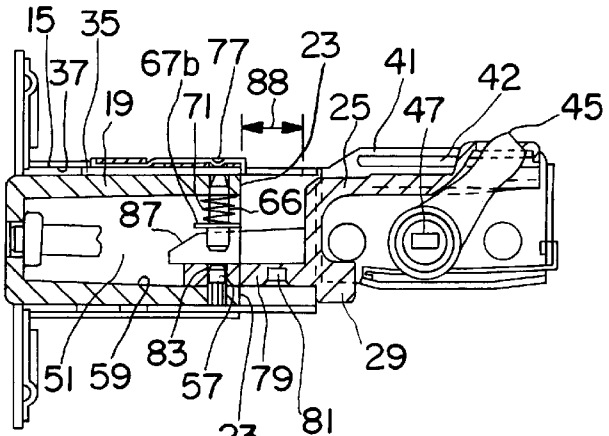
FIG. 5 is the same as FIG. 4 once the push button 29 has ceased to be activated.
Figure 6:
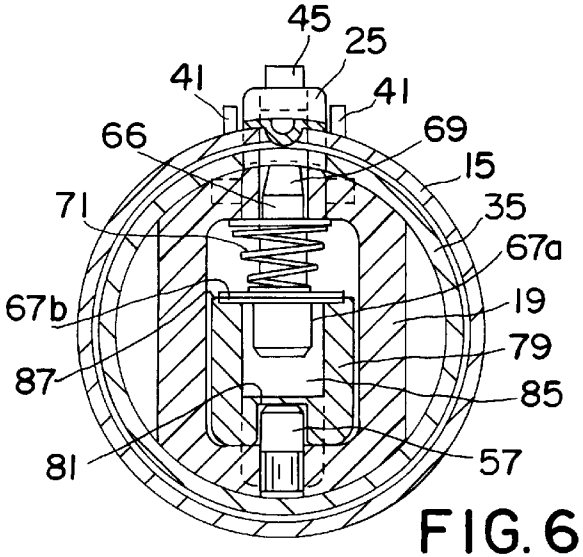
FIG. 6 shows enlarged, sections along VI—VI in FIG. 1A.
Figure 3:
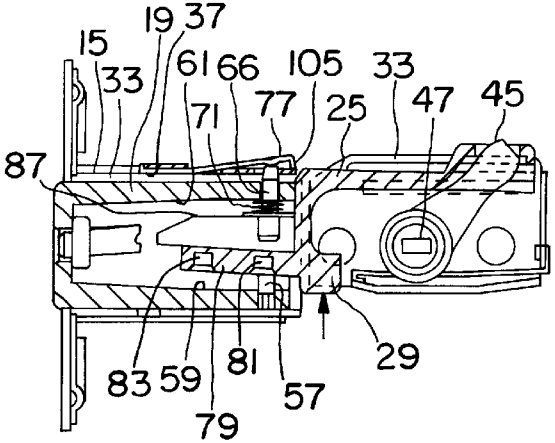
FIG. 3 shows on a smaller scale the latch in FIG. 1 with the push button 29 activated.
Figure 4:
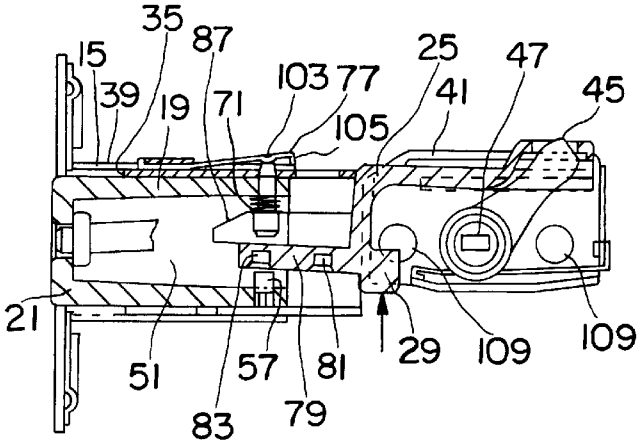
FIG. 4 is FIG. 3 after having extended the latch to its long latch state while the push button 29 is still being pressed.

The back end of the bolt pin 107 of the bolt head 19 is seen outlined on FIG. 1A as a broken line for clarity's sake; this broken line has been eliminated in FIGS. 3, 4, and 5.

DETAILED DESCRIPTION

The latch has advantages in that it is adjustable to a short-length latch or to a long-length latch. The latch, when adjusted to be a short-length latch, is locked in a short position (FIG. 1). The latch, when adjusted to be a long-length latch, is locked in a long position (FIG. 5). In the long position the single bolt (bolt head and bolt tail) has a longer longitudinal length than when in the short position.

An installer locks the latch in either the long position or the short position prior to installation of the latch. The installer selects either the short position or the long position to conform the latch's length to existing door perforations or desired door perforations. The latch, once installed, remains locked in either the short position or the long position. The latch position, however, can be easily unlocked and reset to either the long position or short position. The latch remains locked in the selected short or long position during longitudinal movement imparted by a door handle or a doorknob.

The door latch and its constituent components are designed to be installed in a door. The door latch includes a bolt case 15. The bolt case has a bolt case opening 17 which is designed to be flush with a door's edge (not shown). A bolt head 19 is disposed in the bolt case. The bolt head can occupy an extended position in which the bolt head extends through the bolt case opening. The bolt head can also occupy an opposite retracted position. The latch is shown with the bolt head in the retracted position.

The bolt head has a longitudinal length which is aligned along the longitudinal length of the latch. The bolt head has a bolt head first section 21 facing towards the bolt case opening 17. The bolt head has a bolt head second section 23 opposite the bolt head first section.

A bolt tail 25 is adjustably coupled to the bolt head 19. The bolt tail has a bolt tail first section 27 disposed towards the bolt head second section. The bolt tail includes a bolt tail protrusion 29, a push button. The bolt tail has a bolt tail second section 31.

A bolt case extension 33 has a bolt case extension first section 35 which is disposed between an interior longitudinally extending bolt case surface 37 and an exterior longitudinally extending bolt head surface 39. Thus, the bolt case extension is near the bolt case. The bolt case has a bolt case extension second section 41. The bolt case extension has a longitudinal length aligned with the longitudinal length of the latch. The bolt case extension has a first half 43*a* and a second half 43*b*.

An eccentric 45 is coupled to the bolt tail at the bolt tail second section 31. A doorknob axle 41 is disposed coaxially with the eccentric. The doorknob axle when rotated, for instance by a doorknob, imparts a rotation to the eccentric. The eccentric imparts a longitudinal movement on the bolt tail and bolt head. The bolt tail and bolt head remain fixed relative to each other and move longitudinally as a single bolt. The single bolt (bolt head and bolt tail) slides longitudinally relative to the bolt case and bolt case extension. The bolt case and bolt case extension remain fixed relative to the door during the longitudinal movement. The extension second section has a guide 42 which guides the eccentric and bolt tail during the longitudinal movement. During positioning to the long position from the short position, the bolt tail first section 27 is moved longitudinally away from the bolt head second section 23. The latch is adjusted from the long position to the short position by a reverse movement of the bolt tail and bolt head. The bolt head and bolt tail remain connected before, during and after adjustment from the short to long position, and vice versa.

The bolt case extension 33 is adjusted concurrently with the bolt tail 25 during adjustment of the latch to the preferred short or long position.

The bolt head has a bolt head interior surface 49 which defines a bolt head hollow 51. The bolt head has a bolt head catch 57 on a first bolt head interior surface 59. The bolt head catch 57 is a bolt lug which extends radially towards a second bolt head interior surface 61.

The second bolt head interior surface 61 faces towards the first bolt head interior surface 59. A bolt head hole 63 extends transversely through the second bolt head interior surface 61 and through the bolt head 19, thereby connecting the bolt head hollow 51 to an area exterior to the bolt head.

A spring-loaded lug 65 has a lug shaft 66 which is disposed in the bolt head hole 63. The spring-loaded lug has a lug head 67*a*, 67*b* at one end of the lug shaft. The spring-loaded lug has a lug shaft-end 69 opposite the lug head. The lug head 67*a*, 67*b* is disposed in the bolt head hollow. The section of the lug head towards the second bolt head interior surface 61 forms a collar 67*b*. A helical spring 71 is disposed around the lug shaft 66. The helical spring 71 is between the collar 67*b* and the second bolt head interior surface 61.

The spring-loaded lug has a lug retracted position (FIG. 3, FIG. 4). In the lug retracted position the spring has an increased potential energy. The lug shaft-end 69 extends out of the bolt head hole 63 away from the bolt head hollow 51. The lug shaft-end 69 also extends through a longitudinally extending hole 73 in the bolt case extension first section 35. The lug shaft-end 69 also extends through a bolt case hole 75. The lug shaft-end passes through the bolt case hole exit and connects with a resilient catch 77.

In the retracted position, the lug shaft-end 69 pushes the resilient catch 77 away from an exterior surface of the bolt case (FIG. 3, FIG. 4). The resilient catch is also dislodged from the bolt case extension 33.

The spring-loaded lug also has an extended position (FIG. 1, FIG. 5). In the extended position, the spring has less potential energy than when the spring-loaded lug is in the retracted position. The spring-loaded lug extends further into the bolt head hollow 51 when in the extended position than when in the retracted position.

In the extended position the collar 67*b* is pushing on a bolt tail appendage 79 disposed in the bolt head hollow. The collar pushes on the bolt tail appendage in a direction towards the first bolt head interior surface. In the extended position, the- lug shaft-end 69 is not pushing on the resilient catch 77. The lug shaft-end is not extended through either the bolt case hole 75, the longitudinally extending hole 73 or the bolt head hole 63. The spring-loaded lug and the bolt head catch have their respective vertical axes situated on the median longitudinal plane.

The bolt tail appendage 79 is elongated and extends into the bolt head hollow and away from the bolt tail first section. The bolt tail appendage 79 at its base is integral with the bolt tail first section. The bolt tail appendage includes a bolt tail appendage first catch 81 and a bolt tail appendage second catch 83. The catches 81 and 83 are both shown as openings in an appendage exterior surface facing the first bolt head interior surface 59.

The bolt tail appendage 79 has an appendage interior surface which defines a longitudinally extending chasm 85. The chasm has a longitudinally extending floor bounded by two longitudinally extending lateral walls. The lateral walls have longitudinally extending end surfaces 87 which face the second bolt head interior surface 61. The chasm 85 has a U-shaped cross section. The collar 67 pushes down on the lateral wall end surfaces. A bulbous portion 67*a* of the lug head extends into the chasm.

The pushing force of the collar 67*b* helps to keep the bolt head catch 57 locked with the bolt tail appendage first catch 81 when the latch is in the short position, and helps to keep the bolt head catch locked with the bolt tail appendage second catch 83 when the latch is in the long position. The appendage first 81 and second catches 83 are longitudinally spaced apart a pre-determined distance 88 to coincide with the desired short latch length and the desired long latch length.

The bolt case extension first section 35 has a first catch 89 longitudinally spaced apart from a second catch 91. The case extension first catch 89 is between the longitudinally extending hole 73 and the case extension second section 41. The first catch 89 and second catches 91 are apertures.

The longitudinally extending hole 73 has a longitudinally extending hole first end 93. The longitudinally extending hole has a longitudinally extending hole second end 95 opposite the longitudinally extending hole first end. The longitudinal length 88 of the longitudinally extending hole, measured from the first end 93 to the second end 95, is equal to the longitudinal spacing of the bolt tail appendage first catch 81 and the bolt tail appendage second catch 83.

The case extension second catch 91 is formed by two notches. A first notch 97 is disposed in a first longitudinally extending side of the longitudinally extending hole 73. A second notch 99 is disposed opposite said first notch in a second longitudinally extending side of the longitudinally extending hole 73. The case extension second catch 91 is longitudinally closer to the longitudinally extending hole second end 95 than to the longitudinally extending hole first end 93. The longitudinal distance 88 between the case extension first catch and the case extension second catch is equal to the longitudinal spacing between the bolt tail appendage first catch 81 and the bolt tail appendage second catch 83.

The resilient catch 77 is connected to the bolt case along a side of the bolt case having a bolt case surface facing in the same direction as the exterior longitudinally extending bolt head surface 39. The resilient catch 77 has a resilient catch first section 101 anchored to the bolt case. The resilient catch has a resilient catch second section 103 resiliently displaceable away from the bolt case surface and away from the bolt case hole. The resilient catch second section 103 is displaced by the pushing of the lug shaft-end 69 on the resilient catch when the spring-loaded lug is in the retracted position. The resilient catch second section 103 closely covers the bolt case hole when the spring-loaded lug is in the extended position and thus not pushing on the resilient catch second section 103. The resilient catch second section has a flange 105 which is disposed in the bolt case extension first catch 89 when the latch is in the short position. The resilient catch flange 105 is disposed in the case extension second catch 91 when the latch is in the long position.

In an intermediate position between the short and long latch positions, the push button 29 is depressed and the spring-loaded lug 65 is retracted. The lug shaft 66 abuts up against the longitudinally extending hole first end 93. The lug shaft-end 69 pushes up against the resilient catch 77. The resilient catch is in an unrelaxed position. The case extension first catch 89 is aligned with the resilient catch flange 105. The bolt tail appendage first latch 81 is aligned over the bolt head catch 57. Releasing the push button 29 locks the latch in the short position.

In the short position the spring-loaded lug 65 is extended. The resilient catch flange 105 is locked with the case extension first catch 89. The resilient catch 77 is in the relaxed state closely covering the bolt case hole 75. The bolt head catch 57 is locked with the bolt tail appendage first catch 81.

Adjusting the latch from the short position to the long position is accomplished with relative ease. An installer pushes the bolt tail protrusion 29 in a direction towards the resilient catch. The pushing causes the bolt tail to tilt and the bolt tail appendage first catch 81 to dislodge from the bolt head catch 57. The pushing also causes the bolt tail appendage to push the spring-loaded lug 65 to its retracted position. The retraction causes the lug shaft-end to push the resilient catch 77 away from the bolt case 15. The movement dislodges the resilient catch flange 105 from the case extension first catch 89. The variable positional relationship of the bolt head catch to the bolt tail appendage and the variable positional relationship of the resilient catch to the case extension is thus mutually dependent.

The installer while pushing the bolt tail protrusion 29 also slides the bolt tail 25, case extension 33, and eccentric 45 longitudinally away from the bolt head 19. During this longitudinal movement the case extension first section 35 slides between the longitudinally extending bolt head exterior surface and the longitudinally extending bolt case interior surface. The case extension first section 35 slides in a longitudinal direction away from the bolt head first section 21.

The bolt tail 21, case extension 33, and eccentric 45 slide in unison longitudinally away from the bolt head. During the sliding the longitudinally extending hole second end 95 moves closer to the lug shaft 66. When the latch is ready to be locked in the long position, the lug shaft contacts the longitudinally extending hole second end 95.

The installer releases the push button. The spring-loaded lug enters the extended position. The resilient catch flange 105 locks with the case extension second catch 91. The bolt head catch locks with the bolt tail appendage second catch 83. The resilient catch relaxes and closely covers the bolt case hole 75. The latch is locked in the long position. The simultaneous locking of the bolt head catch and the resilient catch flange demonstrates a mutual dependence between the resilient catch and the bolt head catch.

The installer, to adjust the latch from the long position to the short position, simply repeats the above process but obviously slides the bolt tail, case extension, and eccentric in the opposite direction.

The spring-loaded lug is extended in both the short and long positions. It should also be noted that the adjustment to the short and long positions is shown with the bolt head in the retracted position.

Further, the U-shaped bolt tail appendage should be noted. The configuration helps to stabilize a normal center-mounted bolt pin 107 during the adjustment of the bolt tail from the short to the long position or vice versa. As shown, the bolt pin 107 co-acts with the bolt tail to open and close the bolt head 19.

Additionally, the bolt case extension second section has holes 109 for door mounting pins.

It is important to note that the present invention has been described with reference to an example of an embodiment of the invention. It would be apparent to those skilled in the art that a person understanding this invention may conceive of changes or other embodiments or variations which utilize the principles of the invention without departing from the broader spirit and scope of the invention as set forth in the appended claims. All are considered within the spirit and scope of the invention. The specifications and drawings are therefore to be regarded in an illustrative rather than a restrictive sense. Accordingly, it is not intended that the invention be limited except as may be necessary in view of the appended claims.

I claim:

1. An adaptable latch comprising:

a bolt case, said bolt case having a bolt case opening;

a bolt head, said bolt head having a bolt head interior surface defining a bolt head hollow, said bolt head having a bolt head first section and a bolt head second section, said bolt head disposed in said bolt case;

a bolt tail, said bolt tail having a bolt tail first section and a bolt tail second section;

a bolt tail appendage connected to said bolt tail first section, said bolt tail appendage disposed in said bolt head hollow, said bolt tail appendage having a bolt tail appendage first catch and a bolt tail appendage second catch, said first catch spaced from said second catch along a longitudinal length of said latch;

a bolt head catch disposed in said bolt head hollow, said bolt head catch and said bolt tail appendage have a variable positional relationship selected from a first group consisting of the bolt head catch locked with the bolt tail appendage first catch, the bolt head catch locked with the bolt tail appendage second catch, and the bolt head catch unlocked from the bolt tail appendage;

a resilient catch connected to said bolt case;

a bolt case extension, said bolt case extension having a bolt case extension first catch and a bolt case extension second catch, said bolt case extension first catch and bolt case extension second catch are spaced from each other along a longitudinal length of the latch, said resilient catch and said bolt case extension have a variable positional relationship selected from a second group consisting of the resilient catch locked with said bolt case extension first catch, the resilient catch locked with said bolt case extension second catch, and said resilient catch unlocked from said case extension;

means for moving said bolt head to a retracted position and an extended position relative to said bolt case opening, wherein said means for moving includes means for unlocking said bolt head catch from said; bolt tail appendage, and means for displacing the bolt tail appendage away from said bolt head catch in a direction transverse to said longitudinal length of said latch, and wherein said positional relationship selected from said first group and said positional relationship selected from said second group are mutually dependent.

2. An adaptable latch according to claim 1 further comprising:

a protrusion forming a part of said bolt tail wherein said protrusion is in a position selected from a group consisting of a pressed position and unpressed position, and wherein Positioning said bolt tail protrusion in said pressed position from said undressed position causes adjustment of said bolt tail appendage in said transverse direction away from said bolt head catch.

3. An adaptable latch comprising:

a bolt case, said bolt case having a bolt case opening;

a bolt head, said bolt head having a bolt head interior surface defining a bolt head hollow, said bolt head having a bolt head first section and a bolt head second section, said bolt head disposed in said bolt case;

a bolt tail, said bolt tail having a bolt tail first section and a bolt tail second section;

a bolt tail appendage connected to said bolt tail first section, said bolt tail appendage disposed in said bolt head hollow, said bolt tail appendage having a bolt tail appendage first catch and a bolt tail appendage second catch, said first catch spaced from said second catch alone a longitudinal length of said latch;

a bolt head catch disposed in said bolt head hollow, said bolt head catch and said bolt tail appendage have a variable positional relationship selected from a first group consisting of the bolt head catch locked with the bolt tail appendage first catch, the bolt head catch locked with the bolt tail appendage second catch, and the bolt head catch unlocked from the bolt tail appendage;

a resilient catch connected to said bolt case;

a bolt case extension, said bolt case extension having a bolt case extension first catch and a bolt case extension second catch, said bolt case extension first catch and bolt case extension second catch are spaced from each other along a longitudinal length of the latch, said resilient catch and said bolt case extension have a variable positional relationship selected from a second group consisting of the resilient catch locked with said bolt case extension first catch, the resilient catch locked with said bolt case extension second catch, and said resilient catch unlocked from said case extension;

a bolt case hole extending through the bolt case;

a bolt head hole extending through said bolt head, said bolt case hole aligned with said bolt head hole;

a longitudinally extending hole extending through said case extension, said longitudinally extending hole has a longitudinally extending hole first end and a longitudinally extending hole second end, said longitudinally extending hole is aligned with said bolt head hole;

a spring-loaded lug, said spring-loaded lug has a lug shaft and a lug head, said lug shaft has a lug shaft-end, said lug shaft is disposed in said bolt head hole, said lug head is disposed in the bolt head hollow, said spring-loaded lug pushes on the bolt tail appendage in a direction transverse to the longitudinal length of the latch;

a protrusion forming a part of said bolt tail wherein said protrusion is in a position selected from a qroup consisting of a pressed position and unpressed position;

means for moving said bolt head to a retracted position and an extended position relative to said bolt case opening, wherein said resilient catch covers said bolt case hole in close enough proximity to the bolt case hole to allow said lug shaft-end to push said resilient catch away from said bolt case hole when said spring-loaded lug is in a retracted position, and wherein said positional relationship selected from said first group and said positional relationship selected from said second group are mutually dependent.

4. The adaptable latch of claim 3 further comprising:

an interior surface of the appendage forming a chasm wherein the chasm has a longitudinally extending floor bounded by two longitudinally extending lateral walls, the lateral walls have longitudinally extending end surfaces;

a collar forming part of the spring-loaded lug head, said collar pushing on said longitudinally extending end surfaces; a portion of said lug head extending into said chasm.

5. The adaptable latch of claim 4 wherein:

said spring-loaded lug is retracted;

said lug shaft-end extends out of the bolt head hole away from the bolt head hollow, and further extends through the longitudinally extending hole, and further extends through the bolt case hole, said lug shaft-end pushes the resilient catch away from said bolt case hole, and wherein said positional relationship from the first group is the bolt head catch unlocked from the bolt tail appendage, and wherein said positional relationship from the second group is the resilient catch is unlocked from said case extension.

6. The adaptable latch according to claim 5 wherein the means for moving said bolt head to a retracted position and an extended position comprises:

an eccentric coupled to said bolt tail second section;

a doorknob axle coaxially coupled to said eccentric wherein a rotational movement of said doorknob axle causes a rotational movement of said eccentric.

* * * * *